United States Patent [19]

Black et al.

[11] 4,175,915

[45] Nov. 27, 1979

[54] DRIVE SHAFT LUG FOR VARIABLE DISPLACEMENT COMPRESSOR

[75] Inventors: Dennis A. Black; Raymond N. Mantey, both of Dayton, Ohio

[73] Assignees: General Motors Corporation, Detroit, Mich.; General Motors Corporation, Detroit, Mich.

[21] Appl. No.: 900,744

[22] Filed: Apr. 27, 1978

[51] Int. Cl.[2] ..... F04B 1/06

[52] U.S. Cl. ..... 417/222; 417/269

[58] Field of Search ..... 417/222, 218, 269; 92/12.2

[56] References Cited

U.S. PATENT DOCUMENTS 4,061,443 12/1977 Black et al. ..... 417/222

*Primary Examiner*—William L. Freeh

*Attorney, Agent, or Firm*—Edward P. Barthel; Edward P. Barthel

[57] ABSTRACT

An improved drive lug and shaft through bore structure for use with a wobble plate compressor, the output of which is modulated in response to refrigeration requirements by varying the piston displacement to match the cooling requirement. The drive lug has a cylindrical body formed with a radially outer flat-sided wobble plate connection portion and a radially inner shank of reduced diameter separated by a radiused neck transition portion. A flared opening in the shaft bore receives the neck portion while means on its free end of the shank portion cooperate with the shaft securing the lug in the shaft bore so as to establish a clearance fit between the lug shank and the bore providing extended fatigue life together with ease of manufacture and assembly.

1 Claim, 5 Drawing Figures

DRIVE SHAFT LUG FOR VARIABLE DISPLACEMENT COMPRESSOR

This invention relates to a variable displacement wobble plate refrigerant compressor and more particularly to an improved drive lug and shaft bore structure for use with the compressor.

In co-pending U.S. Patent application Ser. No. 804,932 filed June 9, 1977, now U.S. Pat. No. 4,108,577, to Byron L. Brucken and Dennis A. Black and assigned to the assignee of the present application, a variable displacement wobble plate refrigerant compressor is described which is essentially the same as the present compressor, with novel exceptions, is described. In the exemplary embodiment an improved drive lug and cooperating shaft bore arrangement is disclosed which achieves improved fatigue life over prior art designs such as the tapered lug disclosed in the above-mentioned patent application Ser. No. 804,932. The tapered lug requires a press or close tolerance fit within a conforming tapered bore in the drive shaft necessitating grinding to a finished size to match the tapered bore. This secondary processing which also requires close tolerance lug securing means, such as by a cross pin, obviously creates additional manufacturing costs.

Accordingly, it is an object of the present invention to provide an improved drive lug and shaft bore arrangement for a wobble plate variable capacity compressor wherein the lug is formed from a generally cylindrical body with a radially outer wobble plate connection portion and a radially inner shank portion having a predetermined diameter less than the diameter of the connection portion, together with a radiused neck portion flaring outwardly from said shank portion in a transition from the shank portion to the connection portion; and the shaft bore formed with a flared open end complementary to at least a portion of the neck portion and the bore having a diameter of a predetermined dimension to provide a clearance fit between the shaft bore and the shank portion, such that upon cooperative engagement between securing means on the shank free end and the shaft bore causes the lug neck portion to be brought into snug engagement with the flared open end of the shaft bore providing the clearance fit thereby eliminating the tendency of the lug to be twistingly moved by off-center periodic loading delivered from the wobble plate connection portion resulting in extended fatigue life for the assembly.

Further objects and advantages of the present invention will be apparent from the following description, reference being had to the accompanying drawings wherein preferred embodiments of the present invention are clearly shown.

Figure 1:
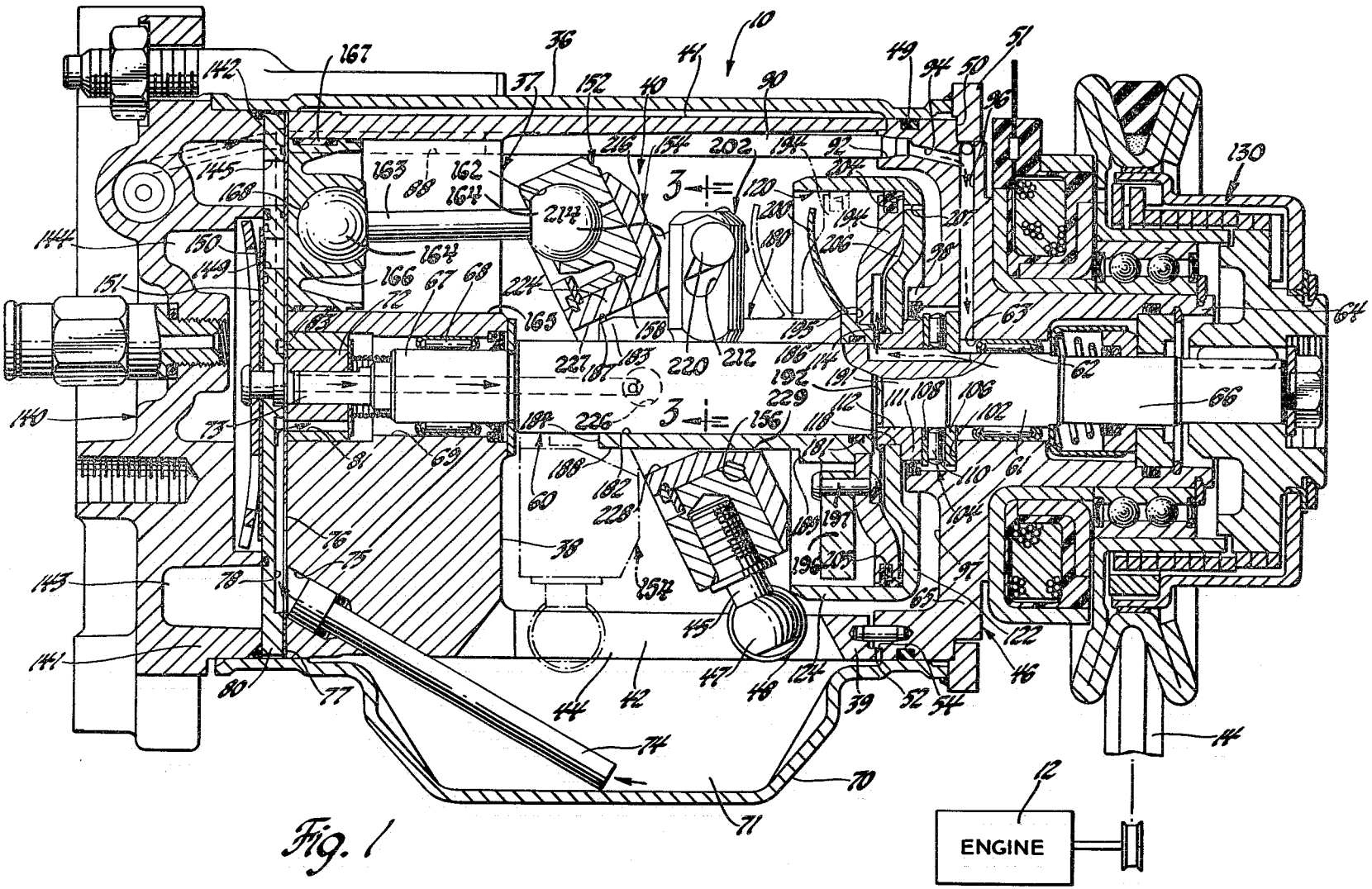
FIG. 1 is a vertical sectional view showing a compressor incorporating the present invention.

Referring now to the drawings, wherein a preferred embodiment of the present invention is shown, numeral 10 in FIG. 1 denotes a variable displacement axial compressor which is adapted to be driven by an automotive engine 12 through suitable drive belt means 14 in a conventional manner as shown and described, for example, in the U.S. Pat. No. 4,061,443, issued Dec. 6, 1977 Black et al.

The compressor for use with the present invention preferably includes an outer housing shell 36, which is substantially cylindrical in shape formed either from sheet metal or as a casting. The shell 36 encircles an inner cylinder case, generally indicated at 37, preferably cast in one piece from aluminum. The case comprises a rear cylinder block 38 and a front cylinder collar 39 with wobble plate mechanism 40 therebetween and interconnected by a pair of longitudinally extending stringers one of which is indicated at 41 and a guide stringer 42. A longitudinal slot 44 is formed in the guide stringer for the reception of a guide pin or rod 45 rotatably supporting a ball 47 in suitable contoured guide shoes 48.

A front head 46, preferably formed as a separate aluminum casting, is partially telescoped in the right-hand or front end of the housing shell 36 and sealed thereto by O-ring seal 49. An outer peripheral notch 50 is formed in the front head 46 for flush engagement of a ring 51, which ring is suitably secured as by welding to circumscribe the front end of the shell 36. The front head 46 has an inner annular recess 52 which telescopically underfits a complementary recess 54 of the collar 39 in nested fashion so as to align the bearing bores for reception of the compressor drive shaft 60.

The drive shaft 60 is shown with its forward bearing portion end 61 rotatably mounted or journaled on front needle bearing 62 and axial bore 63 formed in a protruding integral tubular extension 64 located on the outer surface of the front head end cover portion 65. The extension 64 is coaxial with and surrounds the shaft intermediate end 66 in concentric fashion. The shaft 60 has its rearward reduced end 67, journaled on rearward needle bearing 68 in rear axial bore 69 of the cylinder block 37.

The housing shell 36 completely encloses the compressor wobble plate mechanism 40 and is provided with a distended bulge portion 70 forming an oil sump or crankcase region 71 which collects, by gravity flow, oil and refrigerant mixed therein received from piston blow-by for circulation through the compressor by suitable oil flow passages providing a lubricating network for its associated bearings and seals. Lubricating oil gear pump means in the form of an oil gear pump assembly 72, driven by a D-shaped quill 73, serves to withdraw oil and refrigerant solution from the sump 71 through an oil pickup tube or conduit 74. The tube 74, with its open upper end inserted in angled counterbore 75 of the cylinder block 38, communicates via an aperture 76 in reed valve disc 77 with an aligned vertical slotted passage 78, formed in the inner face of the valve plate 80. The passage 78 has an arcuate shaped upper end (not shown) positioned in communication with the inlet side 81 of the gear pump 72.

The gear pump outlet communicates with an arcuate portion 83 and thence by suitable passage means, not shown, with the rearward end of axially aligned crossover tube 90. The tube 90 is shown with its forward end secured within a conical aperture 92 in the front head 46. The front head 46 provides duct means communicating with the crossover tube 90 in the form of an obliquely downwardly sloped duct portion 94 communicating with the outer end of radial duct portion 96, the inner end of which is opened to the front axial bore 63. Front head 46 inner face 97 includes a sleeve-like concentric extension 98 which, with tubular extension 64, is cast in one piece with the front head. Sleeve-like extension 98 encloses a counterbored shoulder portion 102 defining a thrust bearing surface on which is seated front thrust needle bearing assembly 104, including outer and inner thrust rings 106 and 108 respectively, having needle bearings 110 therebetween. The outer ring is in flush engagement with flange 111 of cylinder bushing 112 fixedly centered as by weld 114 in axial bore 118 of a cup-shaped cylinder, generally designated 120. The cup-shaped cylinder 120 having a base 122 adjacent to the front head cover 65 while its cylindrical wall portion 124 extends rearwardly such that its open end faces the wobble plate mechanism 40. The wobble plate drive mechanism 40 serves to reciprocate a plurality of pistons, to be described, in response to the rotation of the main drive shaft 60. The shaft forward end 66 extends through front head tubular extension 64 for mounting a drive mechanism thereon which may be an electrically engaged clutch 130 shown and described in the above-mentioned U.S. patent application Ser. No. 804,932.

The valve plate 80 is held against the end of the cylinder block 38 by means of cylinder rear head assembly 140 having a cylindrical portion 141 which is telescoped within the aft end of the shell 36 and is sealed thereto by O-ring 142. The rear cylinder head assembly includes an outer suction or inlet chamber 143 and a center discharge chamber 144. As shown in FIG. 1, each compression chamber or bore 165 communicates with the suction chamber 143 through an inlet port such as the port 145. The inlet reed valve disc 77, having inlet reeds (not shown) controls the flow of refrigerant through the suction inlet ports 145 in accordance with standard practice and as shown in the Black, et al U.S. Patent Application Ser. No. 747,043, now U.S. Pat. No. 4,061,443 issued Dec. 6, 1977. The compressed refrigerant leaves each compression bore 165 through a discharge port 149 while the reed valve 150 in a discharge reed valve disc 151, at each discharge port 149 is provided in accordance with standard practice and as exemplified in the patent application Ser. No. 804,932.

The wobble plate drive mechanism assembly 40 includes a socket plate 152 and a journal element or wobble plate 154. The wobble plate 154 and the socket plate 152 define a plane bearing surface 156 and an outer cylindrical journal surface 158 with the wobble plate rotating in unison with the shaft 60. The wobble plate 154 has five sockets, one of the sockets being shown at 162, for receiving the spherical ends of five connecting rods, like the connecting rod 163. The free ends of each of the connecting rods 163 are provided with spherical portions 164 as shown. Cylinder block 38 has a plurality of axial cylinder bores 165, there being five in the preferred embodiment, in which pistons 166 are sealed by rings 167 which in the disclosed form are made from Teflon. Pistons 166, having socket-like formations 168, engage the one end of each connecting rod 163. The pistons 166 operate within their associated compression chambers or bores 165 whereby the rotation of the drive shaft 60 and the wobble plate 154 will cause reciprocation of the pistons 166 within their bores 165.

As seen in FIG. 1, the socket plate 152 is prevented from rotating by means of the guide shoes 48, which slide within the longitudinal slot 44 while supporting the spherical ball 47 in opposed guide shoe sockets. The guide pin rod 45 has its other end threadably received in a bore within the socket plate 152.

The shaft 60 has a generally cylindrical sleeve member 180 surrounding or circumscribing the shaft in hydraulic sealing relation therewith by means of O-ring seal 181 located in a groove in the inner surface 182 of the sleeve. The sleeve member 180 has formed therein a longitudinal slot 183 extending from the sleeve inner or rearward face 184 substantially the full length of the sleeve and terminates in a U-shaped radius portion 186 within the confines of the cup-shaped cylinder 120. The sleeve face 184 includes a chamfered front edge 187 while a planar surface portion 188 is located in 180° opposed relation to the slot 182 which terminates in a notched shoulder 189 to provide clearance with the element or wobble plate 154.

As shown in FIG. 1, sleeve reciprocating actuator or modulation means are provided by a hydraulic expansible chamber which includes the cup-shaped rearwardly opening axially fixed element or modulating cylinder 120, which is secured by means of its bushing 112 on the shaft portion 191 by abutting against shaft shoulder 192 for rotation therewith. The actuator means further includes an axially movable internal disc-shaped modulating piston member 194 including a counterbalance 196 secured by rivet 197 thereto. In the disclosed embodiment the modulating piston 194 abuts sleeve shoulder 195 and is fixed on the sleeve 180 for rotation therewith by means of a return spring member 200 suitably retained on the sleeve. The spring member 200 is operative upon the modulating piston 194 and sleeve 180 being moved axially to the left from its full-line position in FIG. 1 to a compressed dotted line position contacting drive lug means upon the plate mechanism 40 being pivoted to its vertical dotted line zero stroke position relative to the shaft 60. Thus, the spring member 200 functions upon a decrease in pressure in expansible chamber 206 to bias the wobble plate mechanism 40 from its zero stroke position normal to the shaft such that the pistons 166 start pumping and compressing refrigerant gas. It will be noted that suitable hydraulic sealing means are provided between the disc-shaped piston 194 and the inner annular surface of the cylinder 120 which in the disclosed form is a resilient seal ring 204 located in a peripheral groove 205 formed in the edge of the piston 194.

The modulating piston member 194 cooperates with the cylinder 120 to form the expansible chamber 206 the size of which is varied by a hydraulic control system wherein pump 72 supplies lubricant under pressure into the chamber 206. At high lubricant pressures, the disc-shaped piston 194 and sleeve 180 will be shifted axially to the left with its maximum left hand position indicated by dashed lines in FIG. 1. The expansible chamber 206 is unloaded upon a decrease in pressure therein resulting in the piston 194 being moved to the right upon the removal of hydraulic fluid from chamber 206 by suitable passage means such as a bleed hole, shown at 207 in modulating cylinder base wall 122.

Figure 3:
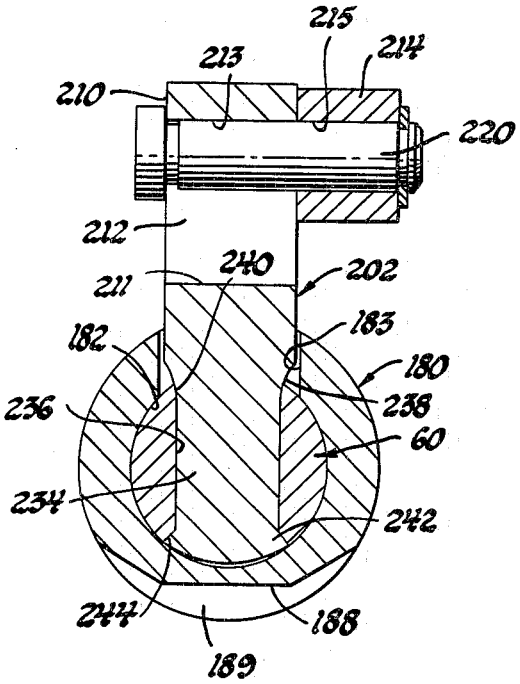
FIG. 3 is an enlarged vertical sectional view taken substantially on the line 3—3 of FIG. 1.

The shaft 60 supports a drive lug 202, the subject of the present invention, which lug comprises a solid generally cylindrical body extending radially or in a transverse direction normal to the axis 208 of the drive shaft. The lug 202 includes a driving connection portion 210 having formed therein a guide slot or cam track 212 which extends radially along the axis of the drive shaft such that the track is at least partially offset from the axis 209 of the lug. The journal element 154 carries an ear-like member 214 projecting normal to the journal forward face 216 and has a through bore 215 for receiving cam follower means in the form of a cross pin driving member or follower 220. As seen in FIG. 3 the ear 214 is offset from but parallel to an imaginary plane common to drive shaft principal axis and the sleeve longitudinal slot 183. Upon the cross pin 220 contacting bottom radius 211 of the cam track 212 the journal element 154 is disposed in a plane perpendicular to the axis of rotation of the shaft 60 rendering the compressor ineffective to compress refrigerant gas. This results from the follower 220 being located at the radially inward limit 211 of cam track 212 defining minimum or zero length for each of the pistons 166. FIG. 1 shows the arrangement of the wobble plate mechanism 40 for maximum compressor capacity wherein the follower 220 is positioned at the radially outer end of cam track 212 defining the maximum stroke lengths for each of the pistons 166.

As shown in FIG. 1 and described more fully in the above-mentioned Black et al Patent application Ser. No. 747,043, journal plate hub 224 receives the sleeve 180 in the hub's generally rectangular sectioned axial opening defined in part by upper and lower faces 227 and 228. The chamfered surface 229, which provides a clearance with sleeve surface 188 in the full stroke position, can be a cast-in-place surface for use as is. Upon assembly the journal hub cross bores 226 are aligned with sleeve bores for the reception of the hollow transverse pivot or trunnion pins (not shown) permitting the wobble plate assembly 40 to pivot thereabout.

As described in the Black et al patent application Ser. No. 747,043, the opposite radiused ends 211 and 213 of the cam track 212 provide one method to define respectively, the maximum and minimum stroke lengths for each of the pistons 166. The result is the wobble plate mechanism 40 provides essentially constant top-dead-center (TDC) positions for each of the pistons. The pin cam follower 220 interconnects the wobble plate mechanism 40 and the drive shaft 60 and is movable radially with respect to the lug 202 and the wobble plate mechanism 40 in response to the movement of the sleeve 180. The angle of the wobble plate mechanism 40 is varied with respect to the drive shaft 60, between the solid and dashed line positions shown, to infinitely vary the stroke lengths of the pistons 166 and thus the output of the compressor.

Figure 2:
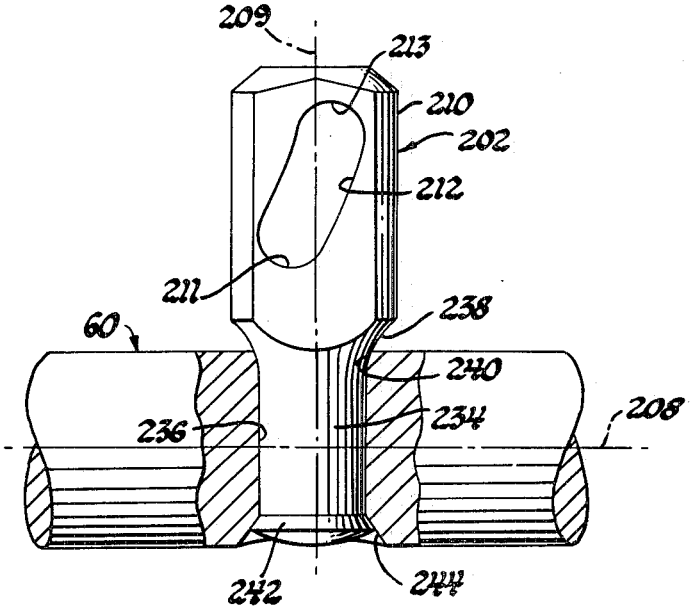
FIG. 2 is an enlarged detail fragmentary view of the shaft and drive lug portion of the compressor.
Figure 4:
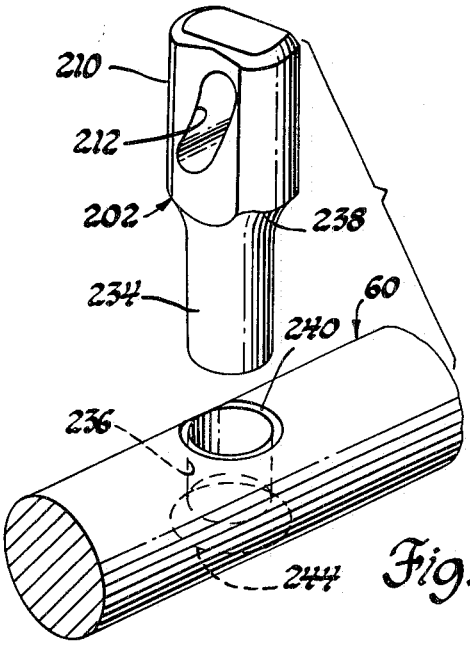
FIG. 4 is an enlarged fragmentary exploded perspective view of the drive lug and cooperating shaft through bore.

As best seen in FIGS. 2, 3, and 4, the shaft drive lug 202 comprises a solid generally cylindrical body formed with the radially outer flat-sided wobble plate connection portion 210 and a radially inner shank portion 234 having a predetermined diameter less than the diameter of the wobble plate connection portion 210. The drive shaft 60 is formed with a through bore 236 the axis of which intersects the shaft axis. The shaft bore 236 has an internal diameter sufficiently larger than the outer diameter of the shank portion 234 to insure a clearance fit therebetween when the shank portion 234 is telescopically received in the shaft bore 236. In the disclosed embodiment the shaft bore 236 has a diameter of about 10.63 centimeters while the shank portion 234 has a diameter of about 10.40 centimeters.

With reference to FIG. 2, the lug 202 has a radiused neck portion 238 flaring outwardly from its shank portion 234 to provide a generous arcuate transition from the shank portion 234 to the wobble plate connection portion 210. In the preferred embodiment the radius of the neck portion is of the order of 12.50 millimeters. The shaft bore 236 is formed with a flared open end 240 which is substantially complementary to at least a portion of the flared neck of the lug to provide line contact engagement between the lug neck portion 238 and the shaft bore flared open end 240. The radius of the shaft flared open end 240 is of the order of 12.75. Thus, by virtue of the bore flared open end 240 having a radius substantially equal to but larger than the radius of the neck portion 238 a line contact is provided adjacent the outer surface of the shaft insuring a minimum moment arm between the cam pin follower 220 and the shaft.

The shank portion lower or free end, opposite from the neck portion 238, has securing means operative to retain the lug 202 on shaft 60. In the embodiment of FIGS. 1–4 the lug securing means is in the form of an upset head or rivet head 242, integral with the shank portion 234. The deformed sideways or outward expansion of the oval-like rivet head 242 shown in FIGS. 2 and 3 provides complementary engagement with counter bore 244 machined in the underside or other lower open end of the shaft bore 236. It will be noted that the lug shank portion 234 is subjected to an axial preload into bore 236 of about 3000 pounds before undergoing upset forging by suitable means such as by an orbital riveter.

The drive lug 202 is thus securely retained in the shaft bore 236 so as to cause the flared neck portion 238 to seat into substantially line contact engagement with the flared open end 240 of the shaft bore while maintaining the clearance fit between the bore 236 and the lug shank portion 234. The resultant reduction of the moment arm between the principal axis of pin 220 and the mentioned line contact provides a unique drive lug arrangement minimizing torque loading. Applicants, by effectively reducing the cam follower pin's tendency to twistingly load and move the lug 202, results in extended fatigue life throughout the operating life of the compressor by eliminating fretting conditions developing at the connection of the lug 202 with the drive shaft 60.

Figure 5:
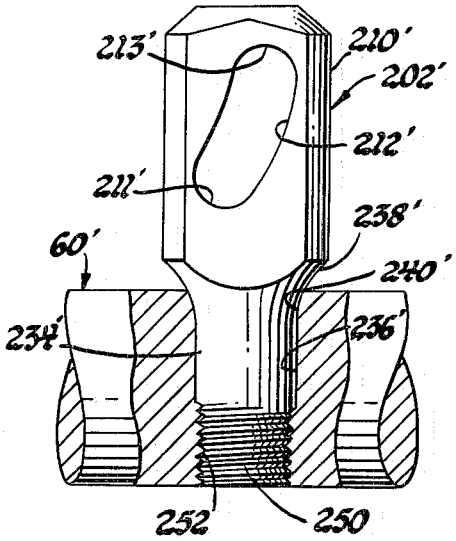
FIG. 5 is a modification of the invention.

A modified form of the invention is shown in FIG. 5 wherein alternative securing means is disclosed. In the description of the securing arrangement of FIG. 5 like components have been assigned like reference numerals, with the addition of primes. It will be seen that the lug shank 234' has its free end threaded at 250 while the lower end of bore 236' is interiorly threaded at 252. By means of the engagement of the threads 250 and 252 the drive lug 202' is securely retained in the shaft bore 236' in a manner to cause the flare neck portion 238' to seat into substantially line contact engagement with the flared open end 240' of the shaft bore 236' while maintaining the clearance fit between the bore 236' and the lug shank portion 234' in the same manner as described in the securing means 242, 244 of the embodiment of FIGS. 1–3.

While the embodiment of the invention as herein disclosed constitutes a preferred form, it is to be understood that other forms might be adopted.

We claim:

1. In a variable output compressor having a housing, a cylinder block disposed in said housing, a circular drive shaft having its one end journaled in one wall of said housing and its other end journaled in said cylinder block, said cylinder block having a plurality of cylinder bores formed therein substantially parallel to the axis of said drive shaft, pistons arranged to reciprocate in said cylinder bores, a wobble plate operated in response to rotation of said shaft and drivingly connected to said pistons, compressor output modulation means including a movable member for varying the angle of said wobble plate relative to said drive shaft and thus the stroke of said pistons in said cylinder bores, said modulation means including a sleeve surrounding said drive shaft in sealing relation therewith and connected to said movable member for axial movement as a unit along the axis of said shaft while maintaining said sealing relation, a longitudinally extending slot in said sleeve, said wobble plate having a pivotal connection with respect to said sleeve for pivotal movement relative to said sleeve and said drive shaft during said axial movement of said sleeve to vary the angle of said wobble plate with respect to said drive shaft, and a radial lug on said drive shaft having a rotary driving connection to said wobble plate, said driving connection including means forming a cam track at least partially offset from the axis of said lug and a follower in said cam track for interconnecting said wobble plate and said drive shaft and movable therein to a position offset from said lug axis in response to movement of said sleeve whereby said angle of said wobble plate is varied with respect to said drive shaft to infinitely vary the stroke of said pistons in said cylinder bores and thus the output of said compressor and whereby the position of said follower as it moves periodically in said cam track to said position offset from the axis of said lug tends to twistingly move and fret said lug in said shaft bore, said lug having a predetermined dimension relative to said slot such that when said lug is received in said slot a longitudinal clearance space is provided between said lug and the sides of said slot throughout the axial movement of said sleeve, the improvement wherein said radial lug comprises a solid generally cylindrical body formed with a radially outer flat sided wobble plate connection portion and radially inner shank portion having a predetermined diameter less than the diameter of said wobble plate connection portion, said drive shaft formed with a through bore the axis of which intersects said shaft axis, said shaft bore having a diameter sufficiently larger than the diameter of said shank portion to provide a clearance fit between said bore and said shank portion when said shank portion is received in said shaft bore, said lug having a radiused neck portion flaring outwardly from said shank portion in a transition from said shank portion to said wobble plate connection portion, said shaft bore formed with a flared open end complementary to at least a portion of the neck portion of said lug, and means formed on the end of said shank portion opposite from said neck portion and cooperating with said shaft for securing said lug on said shaft; said securing means when said shank portion is received in said shaft bore causing the flare on said neck portion to pull into snug coincidental engagement with the flared open end of said shaft bore while maintaining the clearance fit between said bore and said shank portion, whereby to eliminate the tendency of the follower to twistingly move said lug such that said lug has extended fatigue life throughout the operating life of said compressor by eliminating fretting at the connection of said lug with said drive shaft.

* * * * *